United States Patent [19]

Shade, Jr.

[11] 4,223,722

[45] Sep. 23, 1980

[54] CONTROLLABLE INLET HEADER PARTITIONING

[75] Inventor: Russell L. Shade, Jr., Cape Elizabeth, Me.

[73] Assignee: General Electric Company, Schenectady, N.Y.

[21] Appl. No.: 947,658

[22] Filed: Oct. 2, 1978

[51] Int. Cl.[3] ..... F28B 9/02; F28F 9/22; F28D 7/06

[52] U.S. Cl. ..... 165/111; 122/483; 165/139; 165/145; 165/158; 165/174; 165/176

[58] Field of Search ..... 122/483; 165/174, 176, 165/110, 111, 112, 113, 114, 139, 145, 158

[56] References Cited

U.S. PATENT DOCUMENTS

| | | | |
|---|---|---|---|
| 3,073,575 | 1/1963 | Schulenberg | 165/174 |
| 3,390,721 | 7/1968 | Noe | 165/174 |
| 3,534,815 | 10/1970 | Kagi | 165/174 |
| 3,710,854 | 1/1973 | Staub | 165/174 |
| 3,712,272 | 1/1973 | Carnauds et al. | 122/483 |
| 3,713,278 | 1/1973 | Miller et al. | 122/483 |
| 3,731,734 | 5/1973 | Ris et al. | 165/174 |
| 3,759,319 | 9/1973 | Ritland et al. | 165/174 |
| 3,830,293 | 8/1974 | Bell | 165/174 |
| 3,996,897 | 12/1976 | Herzog | 122/483 |

FOREIGN PATENT DOCUMENTS

| | | | |
|---|---|---|---|
| 2236802 | 2/1974 | Fed. Rep. of Germany | 165/174 |
| 2247691 | 5/1975 | France | 122/483 |

*Primary Examiner*—Sheldon Richter
*Attorney, Agent, or Firm*—John F. Ahern

[57] ABSTRACT

An improved reheater for a moisture separator reheater includes an inlet header, an outlet header and a plurality of heat-exchange tubes connected therebetween. The inlet header is partitioned to provide at least two separate sections. Piping and control valves are also provided to supply steam to each section of the inlet header from the reheater inlet pipe. The improved reheater includes at least one bundle of tubes communicating with the header(s) via tubesheet(s). The inlet ends of the tubes may be differentially orificed whereby in combination with a nominal flow rate to the partitions, in-tube condensate subcooling is substantially eliminated with minimal scavenging steam at design conditions. At off-design, or low power level, conditions, where fixed resistances of orifices and fixed partitions cannot accommodate changes in heat transfer demand from tube to tube, the aforementioned control valves are automatically adjusted. This invention effects a controllable inlet header partition resulting in minimal scavenging steam required to substantially eliminate condensate subcooling across the turbine load range.

16 Claims, 4 Drawing Figures

10
12
13
14
15
16
18
19
22
23
24
25
31
32
33
34
39
40
42
43
44
45
46
48
49
50

CONTROLLABLE INLET HEADER PARTITIONING

BACKGROUND OF THE INVENTION

1. Field of the Invention

This invention relates to moisture separator reheaters and more particularly to improved reheaters for moisture separator reheaters used in nuclear steam turbine power plants.

2. Description of the Prior Art

Steam derived from a fossil-fueled boiler is generally hot and dry and contains sufficient energy to operate the high-pressure turbine. Thereafter, it is generally reheated in the boiler so that sufficient useful work may be performed thereby, first in the intermediate and then in low-pressure turbine stages. Steam from a nuclear steam generator or reactor, on the other hand, is generally of relatively low temperature and is saturated. After passing through the high-pressure turbine the nuclear steam contains sufficient entrained moisture that it must be demoisturized, and preferably reheated thereby increasing its enthalpy in order that it reliably perform further useful work.

Moisture separator reheaters (MSR's) of various types are well known in the art. One example of such moisture separator reheaters is disclosed in U.S. Pat. No. 3,712,272, Carnavos et al. The moisture separator reheater disclosed in the Carnavos et al patent employs two reheater sections each of which comprises a bank or bundle of U-shaped tubes extending longitudinally within a pressure-tight shell and including a header for introducing a heating fluid (steam) to the tubes and withdrawing the fluid (condensate) from the tubes. The Carnavos header is provided with a vertical baffle disposed substantially at the middle thereof dividing the header into inlet and outlet sections, with the U-bends of the bundle disposed horizontally. Each tube has one end communicating with the inlet header and another end communicating with the outlet header. In operation, saturated heating steam is fed to the U-shaped tubes through the inlet section of the header, traverses the tubes, and exits, ideally as condensate, from the tubes through a single drain provided in the outlet section of the header.

Another example of a moisture separator reheater employing two reheat tube bundles is described in U.S. Pat. No. 3,713,278, Miller et al. In this design, the header is provided with a substantially horizontal baffle disposed substantially at the middle thereof, dividing the header into an upper inlet header and a lower outlet header. The U-bends are thus disposed in the vertical direction. A further moisture separator reheater design employing a single reheat bundle is disclosed in U.S. Pat. No. 3,593,500, Ritland et al.

Under certain operating conditions, substantial quantities of the reheating steam may condense within the most highly loaded tubes of all these moisture separator reheater designs. If all of the incoming steam to these tubes is completely condensed before the tube end, a buildup of subcooled condensate can result. Problems associated with condensate subcooling, well known to the reheater arts, include reduction in reheater performance, thermal cycling with potential tube-to-tubesheet weld failures, aggravation of tube bundle distortion problems, and in severe cases, overall system instability. It is further well known that selective restriction of certain of the tubes to match tubeside flow rate with actual heat transfer duty can reduce subcooling. Such a solution for the reduction of subcooling in steam heat exchangers is shown by U.S. Pat. No. 3,073,575—Schulenberg. Schulenberg teaches the use of an apertured plate having different sized apertures adjacent to the entrance to different tubes of a heat exchanger to adjust the quantity of steam flowing into respective tubes. In yet another arrangement U.S. Pat. No. 3,830,293 to Bell teaches the use of partitions to divide the surface of a tube plate to provide flow restrictors to provide different quantities of steam to different regions of the tube plate and restricting steam flow at different rates for different groups of tubes.

Unfortunately, "orificing", whether on an individual tube basis as taught by Schulenberg or by groups of tubes as taught by Bell, is not normally a complete answer for the problems of condensate subcooling and related instabilities in moisture separator reheaters. A principal reason for orificing not being a complete solution is that any given orificing arrangement calculated and implemented to distribute the steam flow in the respective tubes so as to satisfy the theoretical heat transfer demand for one given operating condition, normally approximately full loading of the associated turbine, is not ideal for all operating conditions. Orificing which is ideal for one set of conditions may not be suitable for a different set of conditions, e.g., as turbine loading is changed from one power level to another. Thus, for example, orificing is designed to provide a greater flow rate in the most heavily loaded tubes at full load operation in order to preclude condensate subcooling therein by ensuring a flow rate of sufficient magnitude higher than in the other tubes to ensure avoidance of excess condensate.

Tube bundle scavenging flow, well known in the art, is typically "dumped" to a lower point in the system, as described in U.S. Pat. No. 3,724,212, Bell. To substantially eliminate condensate subcooling with orificed bundles, significant quantities of scavenging steam must be drawn through the tube bundles at off-design conditions. This is largely due to reduced loading of the lower tubes with respect to the remaining tubes in the bundle, at lower loadings, rendering the high rate of scavenging flow therein superfluous. Although the quantity of scavenging steam required is less than that for bundles in which orificing is not utilized, a substantial thermodynamic loss results from the dumping of this scavenging steam to lower points in the system.

Alternative techniques to orificing are also known in the art. The use of additional baffling in reheater headers to effect a "four-pass" arrangement is disclosed in U.S. Pat. No. 3,996,897—Herzog, and in U.S. Pat. No. 3,759,319, Ritland. By means of the additional baffling, all of the inlet tubeside flow is restricted to a fraction of the tubes. Following the first two tubeside passes and drainage of condensate formed therein, the remaining steam enters the remaining portion of the bundle which serves as the third and fourth passes. By this technique, the scavenging steam in the first two passes is substantial, whereas the scavenging steam dumped from the fourth pass to a lower point in the system can be kept at a relatively low rate and still substantially eliminate condensate subcooling across the turbine load range.

In the copending application of Reed et al, Ser. No. 890,674, filed Mar. 27, 1978 and commonly assigned, a different approach is taken in substantially eliminating condensate subcooling. With the use of a high $\Delta P$ thermocompressor, high rates of scavenging steam are recirculated in lower pressure reheater tube bundles. With the scavenging steam continually recirculated, the substantial thermodynamic loss associated with the dumping of scavenging steam to lower points in the system is minimized.

As is evident from the four-pass and high ΔP thermocompressor arrangements cited above, high rates of scavenging steam are in many cases beneficial. In some applications, however, it is desirable to minimize the scavenging flow rate so that tubeside velocities and pressure loss are reduced accordingly. In the four-pass arrangement, with all of the incoming steam to the tube bundle entering a fraction of the bundle, the resultant high scavenging flow rate in the second pass implies high tubeside velocities and frictional pressure loss. With high scavenging flow rates via the high ΔP thermocompressor, although recirculated, high tubeside velocities and frictional pressure loss are again characteristic. Therefore, while the arrangements of four-pass and scavenging flow recirculation via high ΔP thermocompressors succeed in substantially eliminating condensate subcooling, potential erosion problems due to high tubeside velocities and performance degradation due to the loss in heating steam temperature associated with the high frictional pressure loss could in some instances become undesirable side effects.

In yet another technique disclosed in U.S. Pat. Nos. 3,731,734 and 3,802,496, assigned to Ris et al, adjustable selective orificing is used in steam condensers. Here the fixed resistances of orificing are dealt with by the utilization of adjustable plates mounted within the steam intake header compartment. This solution, however, necessitates a unit shutdown in order to gain access to the internal adjustable plates. During turbine load changes, for instance, the restrictions would remain fixed.

Accordingly, it is an object of the present invention to provide an improved reheater for a moisture separator reheater which simply and efficiently substantially eliminates condensate subcooling and related instabilities.

It is a further objective to substantially eliminate condensate subcooling with minimal scavenging flow rate and resultant minimal increases in tubeside velocities and pressure loss.

SUMMARY OF THE INVENTION

Briefly described, in one preferred embodiment of this invention, an improved reheater for a moisture separator reheater comprises a generally cylindrical header having a substantially horizontal baffle disposed substantially at the middle thereof, dividing the header into an upper inlet chamber and a lower outlet chamber. A second baffle or partition is also disposed within the upper inlet chamber of the header, defining within that header a second, auxiliary inlet header serving a specific group of tube inlets, dividing the inlet header into two zones. A bundle of U-shaped tubes communicates with the header through a flat tubesheet which also forms one wall of the header. Each tube of the bundle communicates at the ends thereof with the upper inlet chamber and the lower outlet chamber of the header. The inlet ends of the tubes are differentially orificed in order to distribute the incoming reheating fluid (steam) from tube to tube based on a calculated heat transfer demand. Reheating fluid is introduced into the header at the inlet flow chamber via a heating steam inlet pipe, and enters the bundle of U-shaped tubes communicating therewith. A second reheating fluid supply line connected to the first fluid supply line, but separately controllable, is provided for direct input of steam from the primary heating steam inlet pipe into the auxiliary inlet header. Incoming flow to the zone of tubes covered by the auxiliary header, which may be individually orificed as well, is controlled by a valve positioned in the second reheating fluid supply line. The partition itself may also be perforated thereby effecting a nominal, fixed flow resistance. After traversing the U-tubes, the fluid (condensate) and any uncondensed scavenging steam enter the lower outlet chamber of the header. Thus, what is herein referred to as a controllable inlet header partition is provided and includes provision for adjustment of the flow resistance to a zone of tubes in the tube bundle, in addition to the fixed resistances of individual tube orifices, so that the variations in heat transfer duty from tube to tube across the turbine load range can be accommodated with the unit in service, as loading of the MSR changes.

In another preferred embodiment of this invention, the controllable inlet header partitioning is provided in the inlet chamber of a generally cylindrical header having a vertical baffle disposed substantially at the middle thereof, dividing said header into side-by-side and outlet chambers. The U-bends of the U-tubes of the tube bundle are thus substantially disposed in the horizontal direction.

In a further preferred embodiment of this invention, the controllable inlet header partitioning is provided in the inlet chamber of a generally hemispherical header having a substantially horizontal baffle disposed substantially at the middle thereof, dividing said header into upper inlet and lower outlet chambers.

In all embodiments condensate subcooling at the design point, usually full power, is prevented by orificing of the reheater tubes and some scavenging providing greater flow rates through the more heavily loaded tubes. At lower power operation levels at which the loading of the respective tubes of the reheater tube bundle more nearly equalize, particularly in vertically oriented tube bundles, when the increased flow rates in the tubes which are most heavily loaded at full load operation are higher than required, and the flow rates in the tubes which are relatively less heavily loaded at full power may be insufficient, condensate subcooling is still prevented, according to this invention, by increasing the flow rates to the latter tubes rather than maintaining a high rate of scavenging flow in all tubes sufficient to prevent condensate subcooling in all tubes at all levels of loading, thereby reducing all flow rates and the possible consequential loss in efficiency and performance.

Another aspect of the invention is that in vertically oriented U-bend U-tube bundles, those tubes covered with the auxiliary inlet header may be used without orifices therein.

DESCRIPTION OF A PREFERRED EMBODIMENT OF THE INVENTION

Figure 1:
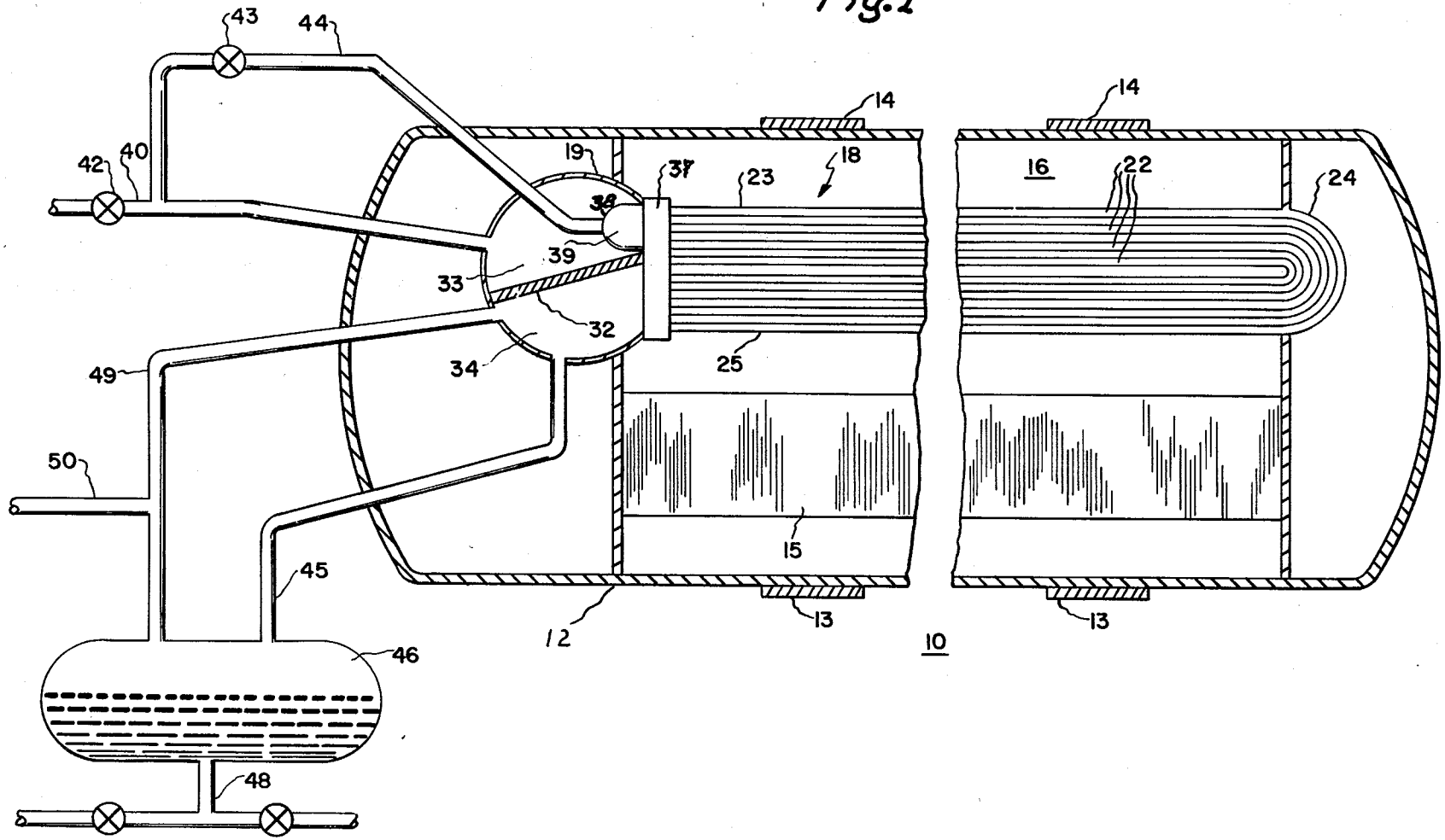
FIG. 1 is a partially schematic vertical cross-sectional view of a moisture separator reheater of one embodiment of the invention.

In FIG. 1 a moisture separator reheater, represented generally at 10, includes a pressure vessel 12 containing a plurality of steam inlets 13 and a plurality of steam outlets 14 to facilitate the passage of steam therethrough in order that it be dried and reheated. Typically such heating at full power may be from a saturated temperature of about 350°–375° F. to a superheated temperature of about 500° F.

Moisture separator panels 15 which are well known in the art and which may, for example, be similar to that disclosed in U.S. Pat. No. 3,667,430, Hubble et al, are disposed over inlets 13 and inlet plenums (not shown) and function to remove substantially all entrained moisture from the shellside steam. The moisture separator panels have a very large surface area with so-called "wiggle plates" and have a drain system therefore (not shown) which collects the moisture drained from the panels and provides a path for removal of the moisture from shell 12.

At least one reheater stage 16 is located immediately above moisture separator panels 15 and is within the path traversed by steam as it passes from inlets 13 to outlets 14. Reheater 16 includes tube bundle 18 and header 19. During such traversal the shellside steam passes in heat transfer relationship across U-tubes 22, each of which carries within it high-pressure saturated steam, the source of which is typically either an extraction taken from a high-pressure turbine stage, or main steam taken from upstream of the high-pressure turbine control valves. Each U-tube 22 comprising tube bundle 18 includes a nearly horizontal section 23, a rounded vertically oriented U-bend section 24, and a nearly horizontal outlet section 25.

Header 19 contains a pass-partition plate 32 which separates the header into an upper inlet chamber 33 and a lower outlet chamber 34. Each tube of tube bundle 18 has an inlet end in communication with the upper inlet chamber 33 and the other end thereof is in communication with the lower outlet chamber 34 of header 19. The inlet and outlet ends of the U-tubes are individually rolled and welded into tubesheet 37, which is an integral structural member of header 19. A header partition 38 is attached to the tubesheet face in the upper inlet chamber 33. This partition, which may conveniently be made from a one-half cylinder with flanges and end caps, covers a fraction of, for example, 50 to 60% of the inlet ends of U-tubes 22, and may be fastened to the tubesheet face, for instance, with stud orifices and retainer combinations (not shown) or by other suitable non-blocking means, thereby avoiding a loss of active tubes, and creating an auxiliary inlet header 39 which serves a specific group of relatively lightly loaded reheater tubes (at full load).

Operationally, high-pressure saturated steam enters reheater 16 through pipe 40, including source valve 42, and enters into inlet chamber 33 of header 19. By controlling valve 43 in line 44, a predetermined fraction of the steam may be fed directly through partition 38. The total steam flow passes through U-tubes 22, thus undergoing two longitudinal passes along the length of and parallel to the longitudinal axis of shell 12 and exercises a curved downward excursion as it reaches the end of the first horizontal excursion and returns to outlet chamber 34 of header 19. During passage through U-tubes 22 a certain proportion of the steam contained therein becomes condensed as it passes with the uncondensed steam to the outlet header chamber from which it is discharged through drain pipe 45 to drain tank 46 exterior of shell 12. The liquid phase in tank 46 is generally drained to a feedwater heater or to the main condenser through line 48. A drain vent line 49 is provided to equalize pressure in the outlet header chamber 34 and drain tank 46. From drain vent line 49 a pipe 50 is provided, typically with a flow restricting orifice and isolation valve (not shown), for passage of the exhausted scavenging steam and any non-condensible gases from the system.

Figure 2:
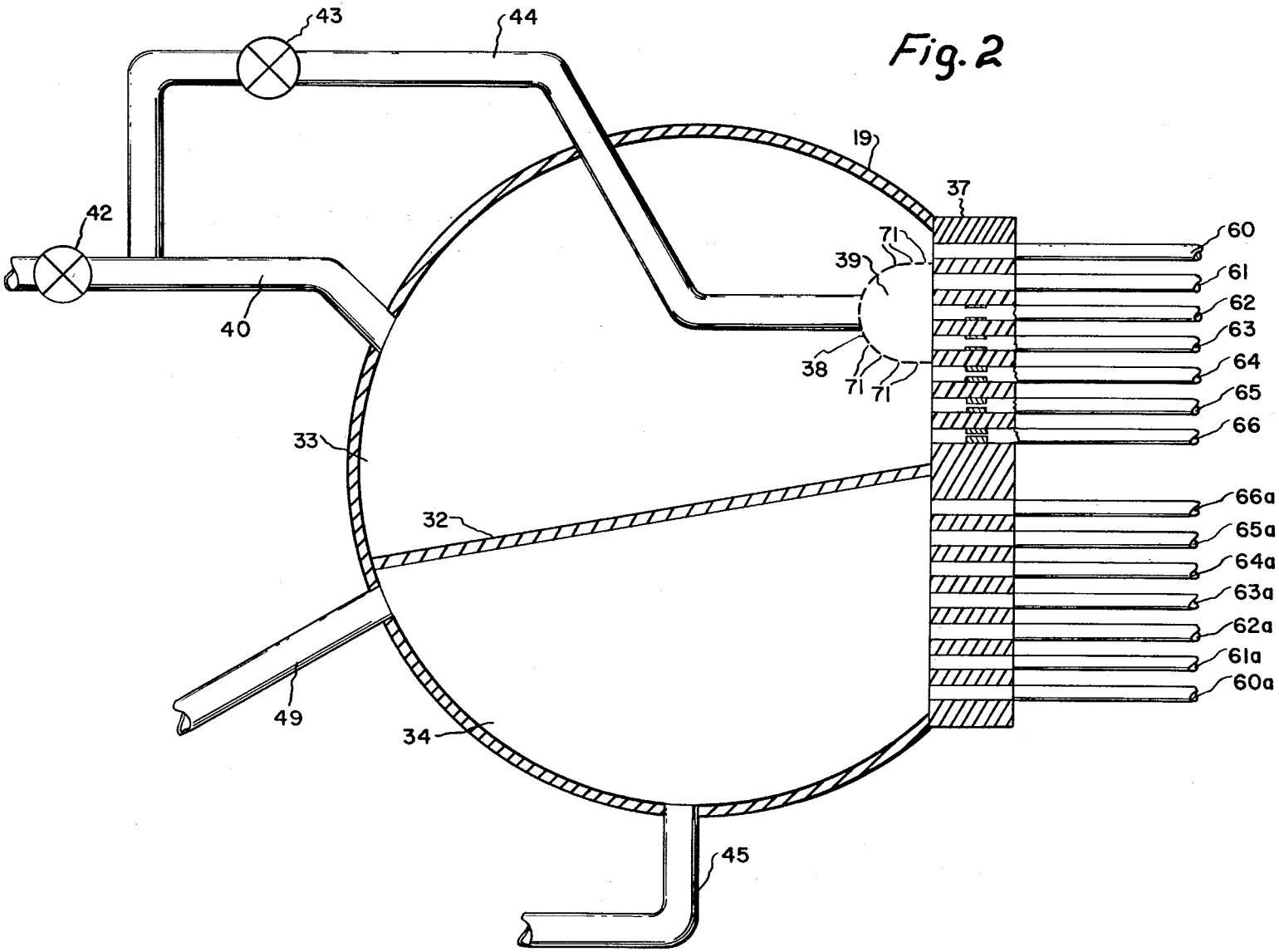
FIG. 2 is a partially schematic vertical cross-sectional view of a cylindrical header for a vertical U-bend tube bundle with partitioning in accord with another embodiment of the invention.

In FIG. 2 the header 19 and the adjacent portions of respective U-tubes 60 through 66 at their interface with tubesheet 37 are illustrated in detail. As may be noted, saturated steam enters the inlet chamber 33 through heating steam inlet pipe 40, and header partition 38 through line 44. In addition, auxiliary header 39 may be perforated as shown at 71. If auxiliary header 39 has no perforations, saturated steam in inlet chamber 33 is distributed through tube 60 and tubes 64 through 66, while saturated steam which enters auxiliary header 39 from line 44, controlled by valve 43, is distributed through tubes 61 through 63. If auxiliary header 39 is perforated as shown at 71, saturated steam which is distributed through tubes 61 through 63 is supplied from either inlet chamber 33 via heating steam inlet pipe 40, when valve 43 is closed, or from a combination of flows from inlet chamber 33 via heating steam inlet pipe 40 and from line 44 with valve 43 at least partially opened. The choice of whether auxiliary header 39 is perforated or not is dependent upon application and physical constraints. If header partition 39 is perforated as shown at 71, with a fraction of the total flow to tubes 61 through 63 supplied from inlet chamber 33, the physical dimensions of line 44 may be smaller than in the case with no perforations in order to provide the same steam flow from within auxiliary header 39. Thus with perforations a fraction of the steam present within header 33 flows into header 39. Added steam from pipe 44 need only supply sufficient steam to add the differential flow to maintain tubes 61–63 free of condensate subcooling and may be smaller and less complex than if header 39 is imperforate and the entire flow rate to tubes 61–63 must be supplied from pipe 44. On the other hand use of imperforate header 39 maximizes control of flow rates for all applications at all valves of turbine loading.

It is also intended that the location of header 39, which covers the inlet ends of U-tubes 61 through 63 as shown, by representative of a general application. The location and size of header 39 may be suitably adjusted for different specific applications. That is to say, the principle applies universally, the exact implementation depends on reheater operating parameters.

The inlet ends of U-tubes 60 through 66 are orificed according to one possible scheme. As illustrated, tube 60, as it returns to the outlet header chamber on the return longitudinal pass, is in heat transfer relationship with the coolest shellside steam. Additionally, if reheater 16 represents the first reheater directly above moisture separator panels 15, tube 60 must supply heat to evaporate any entrained moisture not removed from the shellside steam by the moisture separator panels 15. This situation normally only occurs at high loading conditions. Thus tube 60 tends to have the greatest potential for condensate subcooling therein, particularly at full load. Tube 61, as it returns from the same pass, has a lesser, but still finite possibility of such occurrence. Tube 62 has an even lesser possibility. As the tube number increases to 66 the possibility of condensate subcooling in the return longitudinal pass to the outlet chamber of header 19 becomes almost non-existent, particularly at full load. The orifice in tube 66 is therefore the most restricted so that less steam flows into this tube than any other not so restricted.

With orificing alone, the orifice sizes are typically established for U-tubes 60 through 66 so as to distribute the incoming steam flow consistent with the expected heat transfer demand at high power levels. With the addition of controllable inlet header partitioning in accord with this invention, the orifices in tubes 61 through 63 are of somewhat larger diameter due to the additional series resistance of the partition. Tube 61, for example, which might normally be orificed, is left unorificed when the header partition is used.

Operationally, a nominal flow rate of saturated steam would be directed into the header partition 38 via line 44 controlled by valve 43 and through the fixed perforations 71 (if present). At full turbine load, for instance, this nominal flow rate of saturated steam would represent that passed through these same tubes under the condition of orificing alone, assuming that fixed orifices had been properly sized for full power. As load is reduced and the evaporative duty on the outermost U-tubes is substantially eliminated with typically higher moisture separating effectiveness of panels 15, valve 43, which may be controlled from high-pressure turbine exhaust pressure or another turbine point at which an indication of turbine loading may be obtained, would be further opened, adjusting the steam flow distribution consistent with a lesser maldistribution in heat transfer demand from tube to tube and the relative increased need for flow rate in tubes 61–63, as compared to the remaining tubes. Controllable inlet header partitioning, therefore, counteracts the inefficiencies of fixed orifices at off-design conditions resulting in a substantial elimination of condensate subcooling across the turbine load range in lieu of maintaining a high rate of scavenging flow in all tubes sufficient to substantially eliminate condensate subcooling at all levels of loading.

Figure 3:
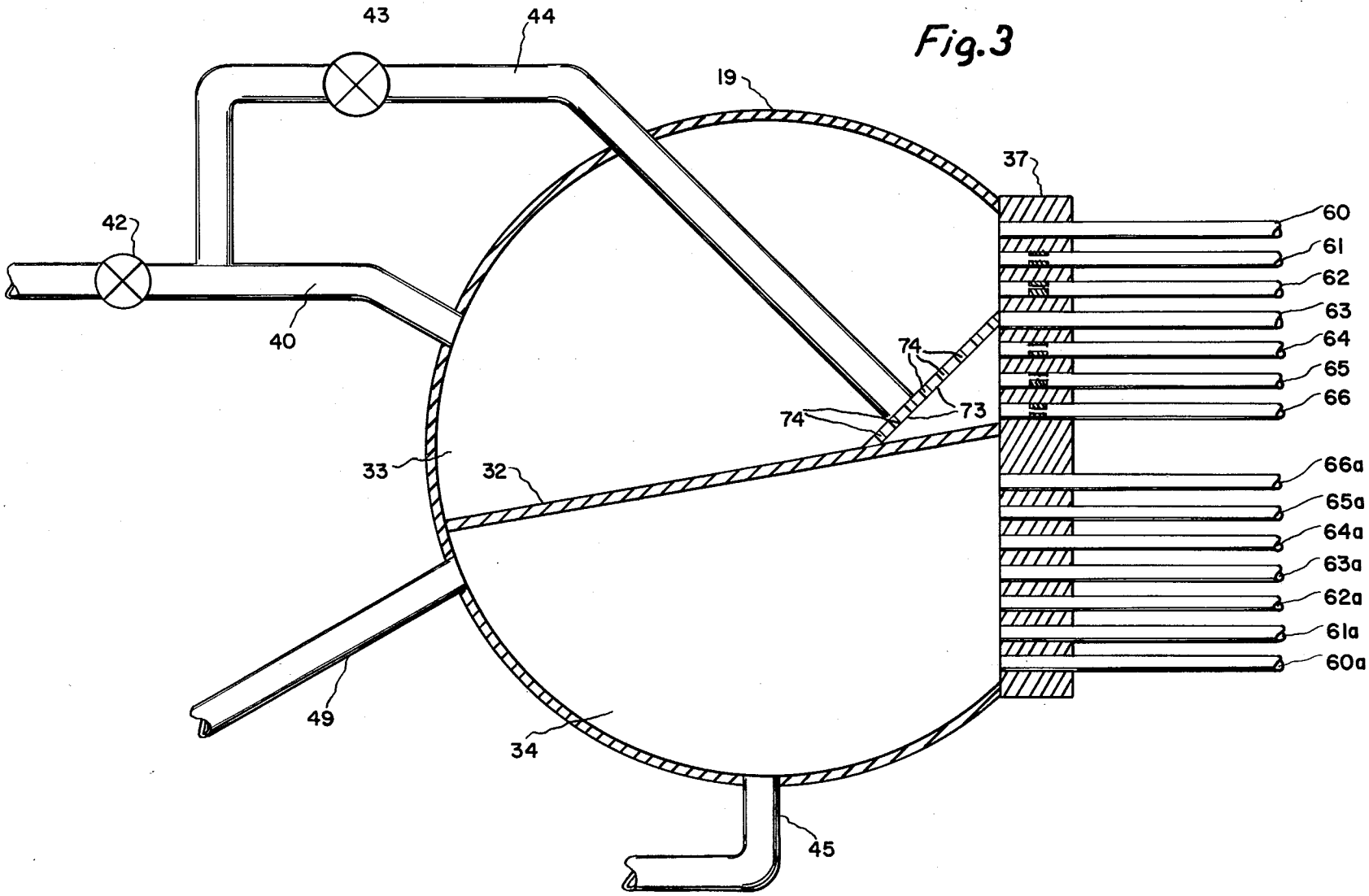
FIG. 3 is a partially schematic vertical cross-sectional view of a cylindrical header for a vertical U-bend tube bundle with baffling in accord with yet another embodiment of the invention.
Figure 4:
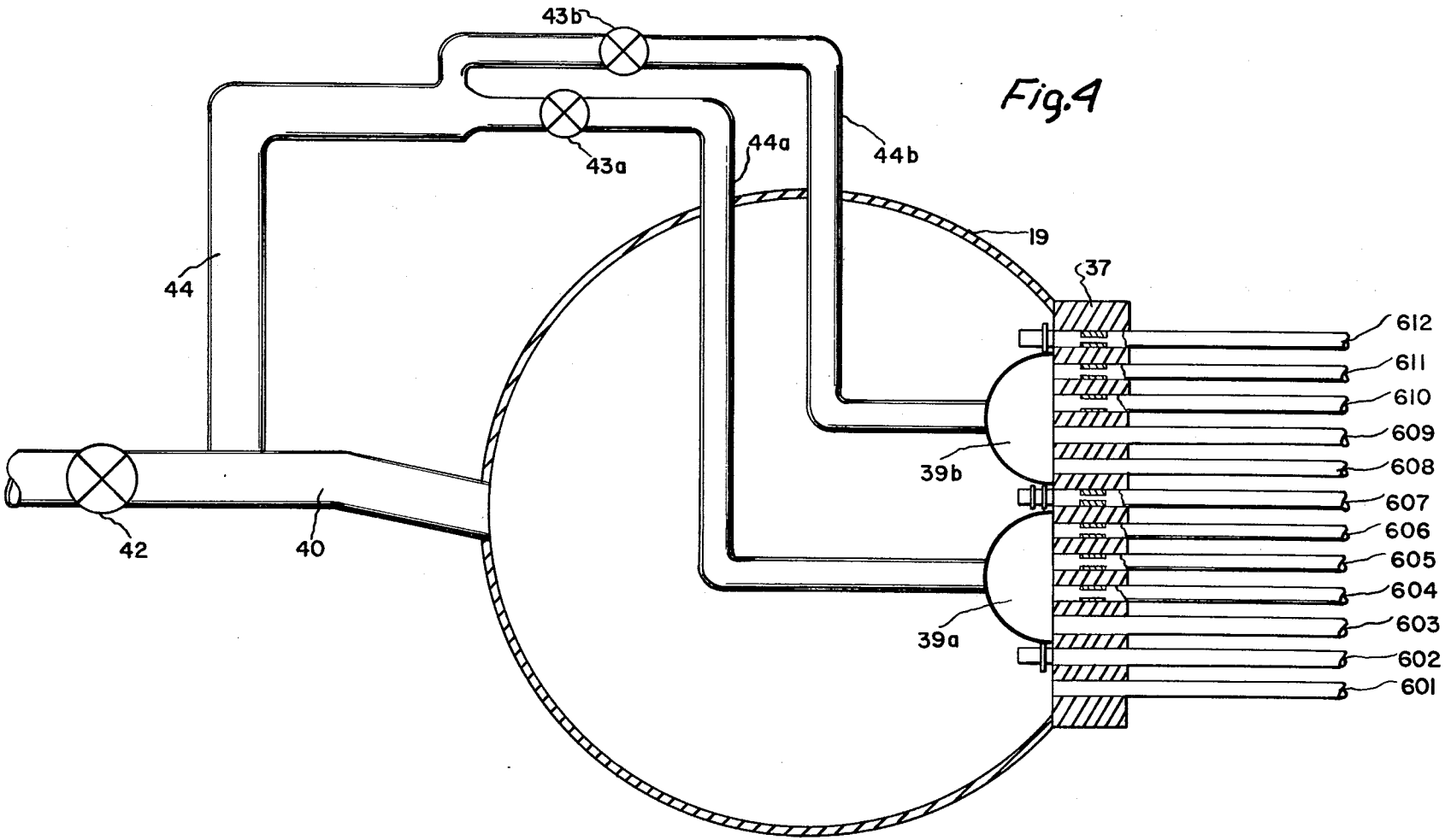
FIG. 4 is a partially schematic vertical cross-sectional view of a header for a horizontal U-bend tube bundle with baffling in accord with still another embodiment of the invention.

In FIG. 3, in accordance with another preferred embodiment of this invention, an alternate form of controllable inlet header partitioning is illustrated for a reheater bundle design which is identical to that illustrated in FIG. 2. Here, in place of header partition 38, a baffle 73 is positioned in inlet header 33. Perforations 74 may be utilized as in the previous arrangement. In this embodiment, tubes 60 through 62 are fed with saturated steam from inlet chamber 33 via heating steam inlet pipe 40, and tubes 63 through 66 are fed with saturated steam from line 44 controlled by valve 43. Operation is similar to that described for the embodiment in FIG. 2.

With baffle 73 covering a different group of tubes than does partition 38 in FIG. 2, the orificing distribution in tubes 60 through 66 is somewhat different. Thus tubes 63–66 are included within the auxiliary header so formed. When the auxiliary header is apertured, the orifices used in these tubes are opened so that the total flow restriction caused by the apertures 74 and the respective tube orifices are essentially the same as in the tube orifices, without the header partitioning. On the other hand the individual tube orifices may be totally removed, particularly if the header partition is imperforate. Since the apertures 74 in FIG. 3 and 71 in FIG. 2 have a finite flow resistance, the presence of valve 43 in pipe 44 gives significant control to the relative flow rates in the various tubes of the tube bundle thus effectuating continuous flow control over the tubes of the tube bundle so as to eliminate condensate subcooling with a minimum of scavenging flow.

The method and apparatus presented in accordance with the present invention of providing a controllable inlet header partition whereby condensate subcooling is substantially eliminated across the turbine load range with minimal scavenging flow rate is thermodynamically very efficient and is accomplished in a simple and economical manner with a minimal number of additional components. With controlled adjustability of the flow resistances from tube to tube the inefficiencies of fixed devices such as orificing are minimized, as are the thermodynamic losses associated with heating steam temperature reduction resulting from the high frictional pressure losses attributable to high scavenging flow rates and also those losses associated with the dumping of high scavenging flow rates to lower points in the system. Furthermore, with minimal effective scavenging flow rates, the tubeside velocities are maintained at relatively low values, reducing the likelihood of erosion problems.

The improvement in MSR operation utilizing the improvement of this invention may be appreciated from the following example of one application of the invention to a single reheater. The structure illustrated in FIG. 2 is applied to substitute for a tube bundle of conventional design using pre-calculated orifices at which the design point if full load. Originally out of 23 rows of tubes (comparable to tubes 60–66) the topmost tube was not orificed and the remainder were progressively orificed with decreasingly smaller orifices. As modified in accord with this invention the auxiliary header covered fourteen intermediate tube rows, (approximately 60% of the tubes in the tube bundle) leaving the top three and the bottom five tubes uncovered by auxiliary header 39. Approximately one hundred ¼ inch apertures were placed in partition 38 and no orifices used in the covered tubes, nor in the topmost tube. The U-tube bundle had a vertical orientation.

The operating parameters of the MSR were as follows:

Shellside steam flow rate full load—1,800,000 #/hr.
Shellside steam saturated at 375° F. input
Superheated at 445° F. output
Tubeside steam flow at full load 145,000 #/hr.
Extraction steam from high-pressure turbine at 500 psia
Saturated at a temperature of 465° F.

A plot of required scavenging steam from full load to 30% load was plotted.

| | Unmodified Orificed Header | Partitioned Inlet Header |
|---|---|---|
| | Scavenging Steam (%) | Scavenging Steam (%) |
| Full Load | 10–15 | 10–15 |

-continued

| | Unmodified Orificed Header | Partitioned Inlet Header |
|---|---|---|
| | Scavenging Steam (%) | Scavenging Steam (%) |
| 30% Load | 40 | 10–15 |

The plotted relationship was essentially linear between the extremes. The advantage of the invention is apparent from the above.

A further advantage of the invention is that it is an alternative to a significant reliance upon pre-operation, calculation-dependent orificing. Thus, standard current practice is to calculate the degree of orificing needed to remove, with scavenging steam, the instabilities due to condensate subcooling. If the pre-assembly assumptions upon which calculations are based are not correct, or if the design point differs from the operating load point, a penalty in wasted steam efficiency may have to be paid for by increasing the rate of scavenging steam, or the MSR may have to be opened up and the orifices changed.

With the present invention the effective orificing is not critical, and flow rates in respective tubes as compared to one another are automatically controlled by valve 43 which is directly responsive to turbine loading.

While the invention has been set forth herein by means of specific descriptions and structures for purposes of a concise explanation, many modifications thereof may readily occur to those skilled in the art. For example, controllable inlet header partitioning is equally applicable to reheater tube bundles employing horizontal U-bend U-tubes, or "straight-through" tubes with separated inlet and outlet headers. It is also equally applicable to differing header designs, e.g., hemispherical headers. Furthermore, although the invention has been described herein for one controllable inlet header partition or baffle in combination with orificing, single partitioning without additional orificing, or multiple partitioning with or without additional orificing may be readily applied. Accordingly, I intend, by the appended claims, to cover all such modifications and changes as fall within the true spirit and scope of this disclosure.

What is claimed is:

1. In a tube and shell reheater having a vapor-tight shell, inlet means for passing cool wet shellside steam thereinto, means within said shell for removing entrained moisture from said shellside steam, and outlet means for removing reheated shellside steam therefrom, at least one reheater therein for raising the temperature of said dried shellside steam, said reheater comprised of an inlet header, including a tubesheet, an outlet header, and a plurality of substantially parallel heat-exchange tubes comprising a tube bundle connected therebetween and extending within said shell between said inlet and said outlet means and in heat-transfer relationship with said shellside steam, the improvement comprising: first means supplying said inlet header with a supply of saturated steam at a temperature and at a pressure both of which are higher than the corresponding characteristic of shellside steam passed into said shell for reheating; partition means within said inlet header for creating therein an auxiliary inlet header which is coupled with and covers inlet ends of a preselected group of said tubes at said tubesheet; separate means for supplying a controllable supply of saturated steam at essentially the same temperature and pressure as said first steam supply means to said auxiliary inlet header; variable flow control means associated with said second steam supply means for controlling the flow rate of saturated steam into said auxiliary header and for independently controlling steam flow rates in said preselected group of tubes; said flow control means being responsive to the loading of said reheater and effective to maintain flow rates in all of said tubes sufficient to substantially eliminate condensate subcooling therein at all values of reheater loading without requiring excessive scavenging steam flow rates in any of said tubes.

2. The apparatus of claim 1 wherein said auxiliary header comprises a flanged cylindrical segment, and is suitably attached to said tubesheet inlet face to avoid loss of active tubes.

3. The apparatus of claim 1 wherein said auxiliary header consists of a baffle plate attached to the header inner wall at one end and to the face of said tubesheet at the other end and extends the length of said inlet header.

4. The apparatus of claim 1 wherein said auxiliary header partition is perforated.

5. The apparatus of claim 1 wherein said inlet header partitioning represents multiple partitions, with multiple steam supply means and control means therefor.

6. The apparatus of claim 1 wherein said inlet ends of said tubes are differentially orificed to distribute steam flow from tube to tube based on heat transfer demand.

7. The apparatus of claim 1 wherein said individual heat transfer tubes in said tube bundle are U-tubes and are oriented in a substantially vertical plane and said inlet and outlet headers comprise separate chambers of a unitary header structure.

8. The apparatus of claim 1 wherein said individual heat transfer tubes in said tube bundle are U-tubes and are oriented in a substantially horizontal plane and said inlet and outlet headers comprise separate chambers of a unitary header structure.

9. A moisture separator reheater for demoisturizing and superheating exhaust steam from an early stage of a nuclear steam turbine-generator and comprising:

(a) a vapor-tight shell;

(b) inlet means for passing wet cool shellside steam exhausted from said early turbine stage into said shell;

(c) outlet means for removing dry superheated steam from said shell;

(d) moisture separator means adjacent said steam inlet means for removing essentially all entrained moisture from said inlet shellside steam;

(e) at least one reheater within said shell between said moisture separator means and said steam outlet means for superheating said dried inlet steam and comprising an inlet header with a tubesheet an outlet header with a tubesheet and a plurality of heat-exchange tubes for passing hot saturated tubeside steam in heat-exchange relationship with said shellside steam;

(f) partition means within said inlet header for forming an auxiliary inlet header within said inlet header adjacent said inlet header tubesheet and coupled with a preselected number of inlet apertures for said heat-exchange tubes at said tubesheet;

(g) first means for supplying from a source associated with said early turbine stage a first flow of saturated steam at a temperature and pressure higher than those characteristics of said inlet shellside steam to the main body of said inlet header;

(h) second means branching from said first supply means for supplying from said source, a second flow of saturated steam at essentially the same temperature and pressure as said first flow to said auxiliary inlet header;

(i) means responsive to turbine loading to control the flow rate of said second flow of saturated steam to said auxiliary inlet header to control steam flow rates in said preselected tubes as a function of turbine loading and to maintain flow rates in all of said tubes sufficient to substantially eliminated condensate subcooling therein at all values of turbine loading without requiring excessive scavenging steam flow rates in any of said tubes.

10. The apparatus of claim 9 wherein said auxiliary header comprises a flanged cylindrical member, suitably attached to said tubesheet inlet face to avoid loss of active tubes.

11. The apparatus of claim 9 wherein said auxiliary header consists of a baffle plate attached to the header inner wall at one end and to the face of said tubesheet at the other end along the length thereof.

12. The apparatus of claim 9 wherein said auxiliary header partition is perforated.

13. The apparatus of claim 9 wherein said inlet header partitioning represents multiple partitions, with multiple steam supply means and control means therefor.

14. The apparatus of claim 9 wherein said inlet ends of said tubes are differentially orificed to distribute steam flow from tube to tube based on heat-transfer demand.

15. The apparatus of claim 9 wherein said individual heat-transfer tubes in said tube bundle are U-tubes and are oriented in a substantially vertical plane and said inlet and outlet headers comprise separate chambers of a unitary header structure.

16. The apparatus of claim 9 wherein said individual heat-transfer tubes in said tube bundle are U-tubes and are oriented in a substantially horizontal plane and said inlet and outlet headers comprise separate chambers of a unitary header structure.

* * * * *